United States Patent [19]

Menchen

[11] 4,134,518

[45] Jan. 16, 1979

[54] COLD BOX WITH BREAKER STRIP

[76] Inventor: Bernie Menchen, 7025 E. Slauson, Commerce, Calif. 90040

[21] Appl. No.: 871,436

[22] Filed: Jan. 23, 1978

[51] Int. Cl.[2] ..... B65D 25/18; B65D 7/22

[52] U.S. Cl. ..... 220/431; 220/434; 220/467; 220/80

[58] Field of Search ..... 220/80, 81 R, 344, 378, 220/430, 431, 434, 467, DIG. 18; 277/181, 187

[56] References Cited

U.S. PATENT DOCUMENTS

| | | | |
|---|---|---|---|
| 2,190,954 | 2/1940 | Stickel | 220/467 |
| 2,256,206 | 9/1941 | Knight | 220/80 X |
| 2,368,542 | 1/1945 | Hall | 220/434 |
| 3,142,405 | 7/1964 | Johnson | 220/431 |
| 3,405,986 | 10/1968 | Cannon | 220/431 X |
| 3,768,687 | 10/1973 | Spencer | 220/431 |

*Primary Examiner*—William Price
*Assistant Examiner*—Steven M. Pollard
*Attorney, Agent, or Firm*—Dominick Nardelli

[57] ABSTRACT

In a cold box having an outer container and an inner liner with the space therebetween filled with insulation and having an access opening capable of being closed with a door, a breaker strip is provided around the opening, fixed to both the outer container and the inner liner. The breaker strip is substantially a flat elongated member having two parallelly spaced flanges protruding from one side and extending the length thereof. The outer container is provided with an inwardly disposed flange disposed around the opening and the inner liner has an outwardly disposed flange, also disposed around the opening. Along each edge of both flanges is formed a U-shaped channel to receive a respective one of the flanges on the breaker strip. Male and female snap-type locking means are provided on each flange of the breaker strip and on each U-shaped channel, respectively, to secure the two when the two items are assembled.

4 Claims, 3 Drawing Figures

COLD BOX WITH BREAKER STRIP

FIELD OF THE INVENTION

This invention relates to a means of attaching a breaker strip around the opening of a cold box and, more particularly, to a means which is more simple, secure and reliable.

BACKGROUND OF THE INVENTION

Cold boxes for refrigeration are constructed by placing an inner liner inside a container and filling the space therebetween with insulation. The standard insulation now in use is plastic foam that is expanded in place. Naturally, a cold box must have an access opening which is closed by a hinged door. In the past, the method of attaching the periphery of the opening on the outer container to the periphery of the opening on the inner container was complicated and expensive. Also, in many applications, the opening was required to be covered with a breaker made, preferably, of plastic so that when heavy solid items such as a beer barrel, is knocked thereagainst, the cold box is not damaged to the point where the door would not seal effectively. In addition, since the outer container and inner liner are made of sheet metal, and if one attempts to place a sheet metal frame around the opening, this frame should be permanently welded or effectively sealed in place to prevent moisture from entering the space where the insulation is located. It is well known that moisture will deteriorate the insulation on freezing. One skilled in the art can visualize how difficult it would be to suitably weld or seal this metal frame around the opening without degrading the aesthetic effect of the cold box, and also do it economically.

OBJECTS OF THE INVENTION

An object of this invention is to provide an improved means for attaching a breaker strip around the opening of a cold box.

Another object of this invention is to provide a more simple, secure and reliable breaker strip around the opening of a cold box made of metal.

These and other objects and features of advantage will become more apparent after studying the following description of the preferred embodiment of my invention, together with the appending drawing.

DETAILED DESCRIPTION OF THE DRAWING

Item 11 represents a cold box wherein the interior thereof is maintained at a lower temperature than ambient temperature by suitably refrigeration means, not shown. The box 11 has a rectangular opening 12 which is shown to be on the side of the box. However, opening 12 could be formed in the top of the box if one desires.

The opening 12 would normally be closed by a hinged door, also not shown. Cold boxes, in general, are standard in the art. My improvement lies in the means of constructing the opening 12 in the box 11.

Figure 1:
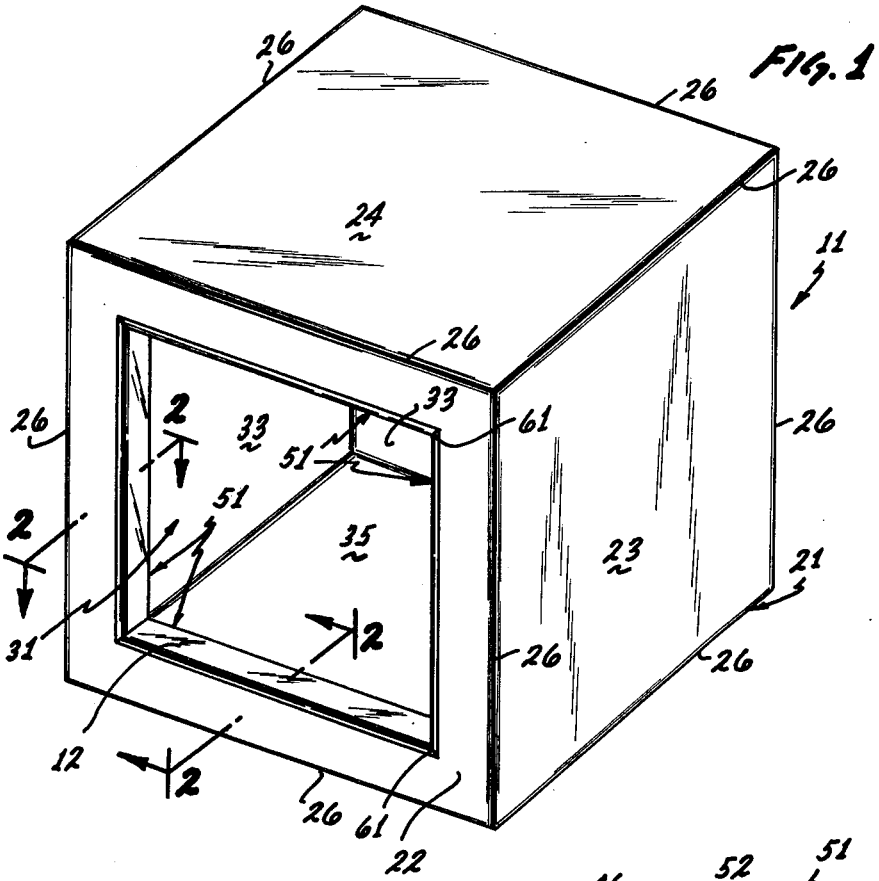
FIG. 1 is a pictorially simplified representation of a typical cold box employing my invention.
Figure 2:
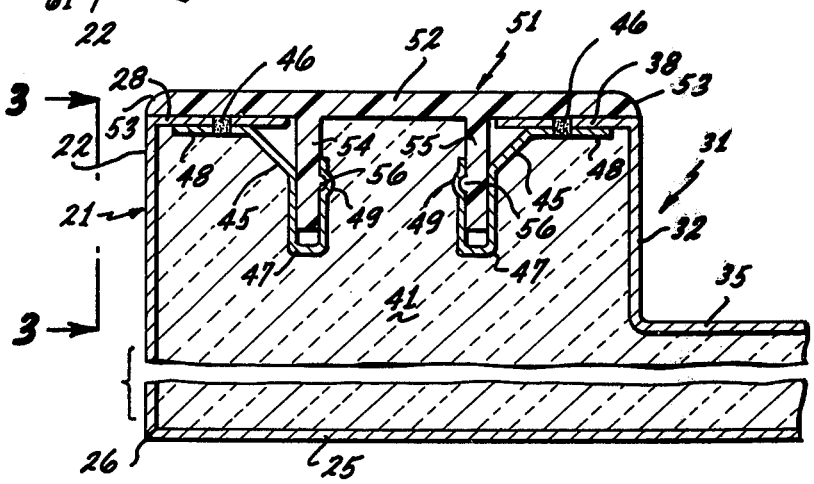
FIG. 2 is a partial section taken on either plane represented by 2—2 in the direction of the arrows of FIG. 1, showing one embodiment of my improved means for securing a breaker strip around an opening in the cold box.
Figure 3:
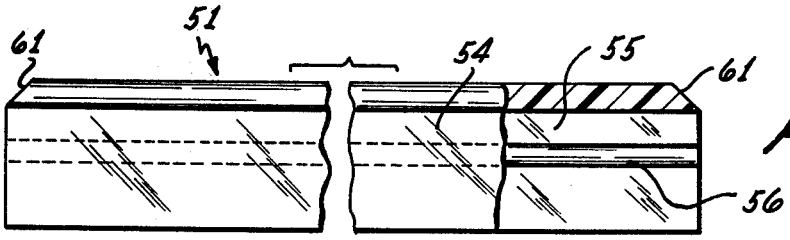
FIG. 3 is a side elevation view, partially broken away, of a breaker strip as removed from the cold box and, more particularly, as would be viewed on line 3—3 of FIG. 2 in the direction of the arrows.

Referring to FIGS. 2 and 3, my novel means will now be described in detail. The cold box 11 has an outer container 21 made, preferably, of sheet metal. The outer container has an annular front panel 22, two side panels, and a rear panel, such as panel 23, a top panel 24 and a bottom panel 25. These six panels 22, 23, 24, and 25 are suitably welded together along the edges such as edges 26 to form a rectangular box. Around the inner periphery of panel 22 is formed an inwardly directed flange 28. The cold box 11 also has an inner liner 31 made, preferably, of sheet metal. The liner 31 has an annular front panel 32 spaced from panel 22, two side panels, and a back panel such as panels 33, a bottom panel 35 and a top panel (not shown). Each of the panels on the inner liner are spaced from each respective panel forming the outer container 21 so that a space 41 is formed therebetween which can be filled with suitable insulation material, also represented by 41.

The front panel 32 has formed around its inner periphery an outwardly extending flange 38. Within space 41 and to each flange 28 and 33 a specially shaped channel 45 is welded by, for example, spot welds 46. Each channel 45 has a deep groove formed in its body portion 47 wherein the deep groove is made by bending the body portion 47 into a 180° bight. Each channel also has a flange 48 extending substantially at right angles from one side of the body portion. The other side of the body portion has at least one corrugation 49 formed longitudinally thereon. The function of corrugation 49 will be explained more fully hereinafter. The spacing between the two body portions 47 on the channels 45 is predetermined or preset for reasons that will also be explained hereinafter.

Around the opening 12 is placed a breaker, preferably made of plastic to seal off the space 41 and protect the insulation therein. Since the opening is rectangular, the breaker is made of four breaker strips or sections, such as strip 51, as shown in FIG. 3. The strip 51 has a plate 52 wherein round edges 53 are provided on its exposed side. Depending from the underside are a pair of parallel flanges 54 and 55, which are spaced apart the same distance as the body portions 47 are spaced so that the grooves in the body portion 47 are capable of receiving flanges 54 and 55, respectively. Running lengthwise and on each flange 54 and 55 is a ridge 56 which is the counterpart of corrugation 49 so that ridge 56 nests therein, as shown. The metal which each channel 45 is made of is preferably stainless steel which has good elastic properties so that as one places the strip 51 in place, the ridges 56 snap into corrugations 49, holding the strip in place against the flanges 28 and 38 with moderate force. One understands that the distance ridge 56 is placed below the plate 52 should be the same or slightly less than the distance corrugation 49 is placed from the top of flanges 28 and 38 on panels 22 and 32, respectively, so that the underside of plate 52 bears against the top of each flange 28 and 38. The strip 51, being made of a suitable plastic, thereby forms an effective seal. The ends of each plate 52 are champered at a 45° angle to form a bevel 61 to allow for the rectangular shaped opening.

Having described the preferred embodiment of my invention, one skilled in the art, after reading the above, can devise other embodiments without departing from the spirit of my invention. Therefore my invention is not to be considered limited to the disclosed embodiment, but includes all embodiments falling within the scope of the appended claims.

I claim:

1. A cold box comprising:

an outer container;

an inner liner disposed within and spaced from said outer container;

said outer container and said inner liner each having an opening which are aligned with each other and substantially the same size and shape;

said outer container and said inner liner being made of a rigid sheet like material;

said opening on said outer container having disposed around its periphery an inwardly directed flange;

said opening on said inner liner having disposed around its periphery an outwardly directed flange so that it is coplaner with said flange on said outer container;

a first channel disposed around and fixed to said flange on said outer container;

a second channel disposed around and fixed to said flange on said inner liner;

said first channel having a first deep groove formed along its length and disposed between the space formed by said container and said liner and extending beyond said flange on said container towards said liner;

said second channel having a second deep groove formed along its length and disposed between the space formed by said container and said liner and extending beyond said flange on said liner towards said container;

a breaker strip having an elongated plate and a pair of parallelly disposed flanges disposed at right angles to said plate and spaced inwardly from and parallel to both edges of said plate;

locking means on said parallel flanges and said deep grooves to cause said flanges to become secure within said grooves when said flanges are inserted therein.

2. The cold box of claim 1 wherein said locking means comprises:

at least one corrugation formed on one side of said body portion on each of said channels;

at least one ridge formed on each of said flanges on said breaker strip and disposed to cooperate with said corrugation on the respective one of said channel.

3. The cold box of claim 2 wherein each of said channels comprises:

a body portion;

a flange portion disposed substantially at right angles to and attached to said body portion;

said body portion being formed with a 180° bight to form said deep groove;

said flange portion being welded to one of said flanges on said container and said liner.

4. The cold box of claim 3 wherein said corrugation is formed on said body portion in the section of the bight removed from said flange.

* * * * *